US005185938A

United States Patent [19]

Hutt

[11] Patent Number: 5,185,938

[45] Date of Patent: Feb. 16, 1993

[54] PAINT BRUSH AND ROLLER CLEANER

[76] Inventor: Heinz Hutt, 472 Place Closse, Ile Bizard, Canada, H9C 1Y6

[21] Appl. No.: 833,116

[22] Filed: Feb. 10, 1992

[51] Int. Cl.[5] ..... F26B 17/24

[52] U.S. Cl. ..... 34/58; 15/246

[58] Field of Search ..... 34/58, 8, 59; 15/236.1, 15/246, 159 R, 105

[56] References Cited

U.S. PATENT DOCUMENTS

| | | | |
|---|---|---|---|
| 207,620 | 9/1878 | Parmelee . | |
| 2,794,265 | 6/1957 | Kruger . | |
| 2,854,709 | 5/1959 | Kruger . | |
| 2,902,773 | 9/1959 | Dudek . | |
| 2,912,769 | 11/1959 | Kruger . | |
| 3,925,908 | 12/1975 | Dunn | 34/58 |
| 2,983,036 | 5/1961 | Guard . | |

FOREIGN PATENT DOCUMENTS

| | | |
|---|---|---|
| 826367 | 10/1969 | Canada . |
| 905614 | 7/1972 | Canada . |

*Primary Examiner*—Henry A. Bennett

*Attorney, Agent, or Firm*—Pierre Lespérance; Francois Martineau

[57] ABSTRACT

An attachment securable to the chuck of a hand-held power drill and adapted to clamp either a paint brush or a paint roller, so as to spin the same for cleaning by centrifugal force. The attachment is made of three separate parts, namely: a jaw unit, a sleeve and a cap nut, the latter provided with a spindle for insertion into the power tool chuck. The jaw unit includes a screw portion threaded within the cap nut and having a cylindrical extension in turn extended by a pair of spring jaws for receiving therebetween and clamping the narrower portion of a paint brush handle adjacent the brush bristles. A sleeve surrounds the arms of the two jaws and its opposite ends engage the cap nut and conical wedging surfaces of the jaw heads. Rotation of the cap nut with respect to the jaw unit causes axial movement of the sleeve which in turn causes retraction of the jaw to clamp the brush handle. The outer surface of the sleeve has paint roller clamping ribs to hold a paint roller around the sleeve. In the second embodiment, the outer end of the sleeve is provided with slits defining deflectable lugs therebetween, which are deflected radially outwardly upon further insertion of the jaw heads within the sleeve, so as to provide additional clamping of the paint brush roller.

13 Claims, 4 Drawing Sheets

PAINT BRUSH AND ROLLER CLEANER

FIELD OF THE INVENTION

The present invention relates to an attachment for cleaning by centrifugal force paint brushes and paint rollers, the attachment serving to secure either the brush or the roller to a power-operated rotary tool for spinning.

BACKGROUND OF THE INVENTION

It is known to provide a vise type device to spin either a paint brush or a paint roller, either manually or by using an electric motor, more particularly a hand-held power tool such as a power drill. Typical of such devices is the one described in Canadian Patent 825,367, issued Oct. 21, 1969 to Torlo International Limited. In this Patent, spring jaws are positively inwardly pressed by a ring member to clamp a paint brush handle, or a paint brush roller is held around the spring jaws under the outward bias of the same. It is firmly believed that spinning at relatively high speed of a paint brush roller by such a vise, will often result in the detachment of the roller, since the outer force exerted by the spring jaws to keep the roller in position, is not sufficient. If the spring jaws were made to exert a sufficient outward force, then the inward force, which would have to be exerted by the sliding down of the ring member around the spring jaws, would be too great for a user of average force to easily cause clamping of the jaws on the paint brush handle. Moreover, the vise in accordance with this patent cannot uniformly clamp a paint roller cover along its length.

OBJECTS OF THE INVENTION

It is therefore the general object of the invention to provide a vise type attachment for spinning paint brushes and also paint rollers in an efficient manner, while overcoming the above-noted disadvantages.

Another object of the present invention is to provide a vise type attachment of the character described, adapted to clamp rollers having a certain variation in its internal diameter and also various sizes of paint brush handles.

Another object of the present invention is the provision of a vice type attachment of the character described, having only three separate parts, resulting in a device of simple and inexpensive construction and which is easily assembled.

SUMMARY OF THE INVENTION

The vise type attachment in accordance with the invention includes a jaw unit, a nut and a sleeve and is provided with a spindle adapted to be secured in the chuck of a hand held power tool. The jaw unit includes a screw portion with external screw threads and having a cylindrical extension which defines a generally cylindrical bore to receive and center the pointed tip of a paint brush handle. The jaw unit further includes spring jaws integrally formed with the cylindrical extension and including elongated, resilient arms, each terminated by a jaw head having an inner handle clamping surface and an outer generally conical wedging surface. A nut surrounds and is screwed on the screw portion of the jaw unit. A cylindrical sleeve surrounds the cylindrical extension and the arms of the jaw unit. The inner end of said sleeve is engaged by said nut, while the outer end of said sleeve engages the wedging surfaces of the jaw heads. When the nut is screwed on the screw portion of the jaw unit, it pushes the sleeve into engagement with the wedging surfaces of the jaw heads, thereby causing retraction movement of said jaw heads and consequent clamping of the same on a paint brush handle which is inserted between the spring jaws, with the tip held by the cylindrical extension of the jaw unit. The sleeve has roller-clamping means at its outer surface, to positively hold a roller in which said sleeve is inserted. Preferably, said roller-clamping means include tapered ribs at the inner end of said sleeve and outwardly-deflectable end sections formed at the outer end of the sleeve, said end sections being outwardly deflected to clamp the paint roller by partial entrance of said jaw heads within said sleeve with the jaw heads having end abutment surfaces in mutual engagement to prevent further retraction of said jaw heads.

DETAILED DESCRIPTION OF THE TWO PREFERRED EMBODIMENTS

Figure 1:
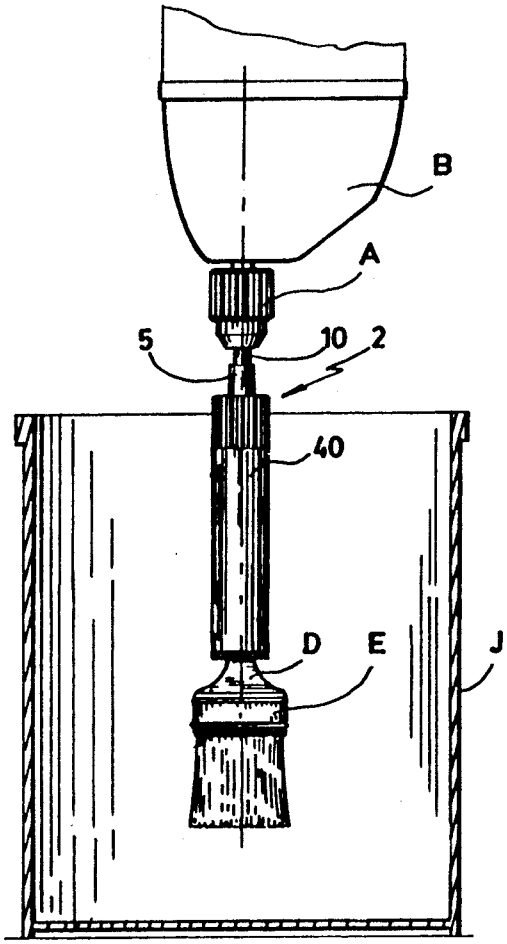
FIG. 1 is an elevation of the vise type attachment of the invention shown in operative position, being attached to the chuck of a power tool and holding a paint brush for spinning the same inside a container shown in vertical section.
Figure 2:
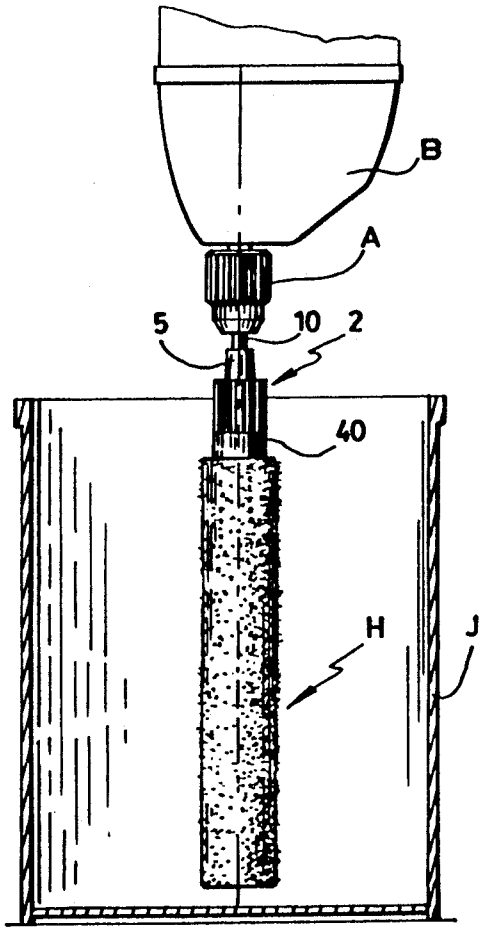
FIG. 2 is a view similar to that of FIG. 1 but showing a paint brush roller clamped by the attachment of the invention for spinning said roller.
Figure 3:
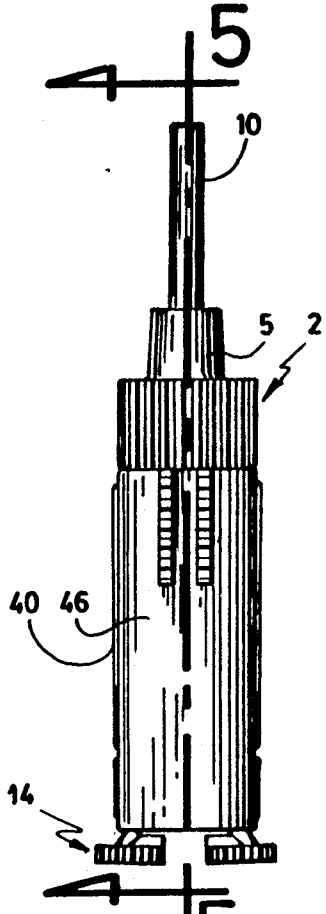
FIG. 3 is an elevation of the attachment of the invention.
Figure 4:
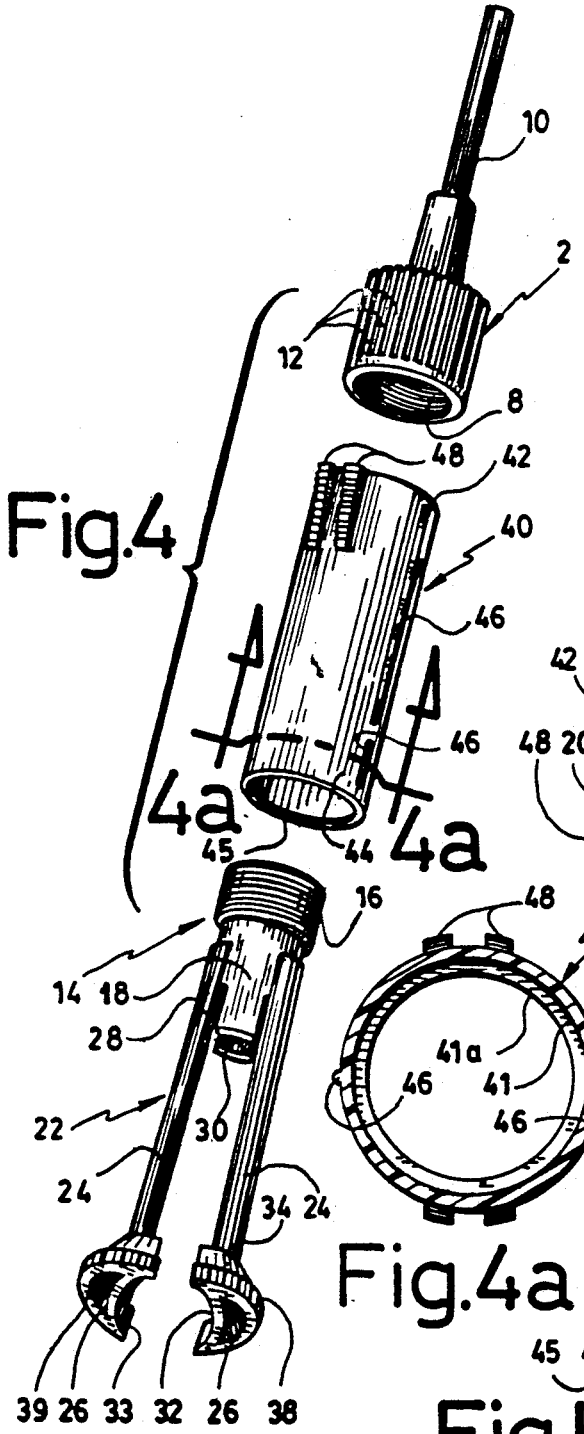
FIG. 4 is an exploded perspective view of the attachment of the invention.
Figure 4A:
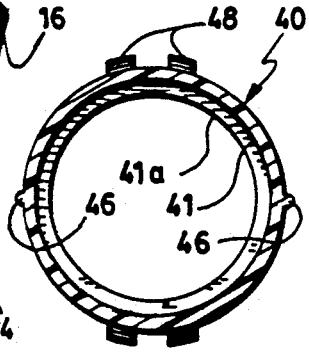
FIG. 4*a* is a cross-section of the sleeve, taken along line 4*a*—4*a* of FIG. 4.

Referring to the first embodiment of the invention, illustrated in FIGS. 1 to 9 inclusive, the vise type attachment of the invention comprises a cap nut 2, which includes an end wall 4 and a cylindrical skirt 6 provided inner threads 8. A spindle 10 is fixed within the end wall 4 and surrounding boss 5. Spindle 10 is made of tempered steel, while the cap nut 2 is molded out of synthetic resin, such as nylon. The skirt 6 has an outer longitudinally-extending knurling 12 to prevent slipping in the operator's hand. Spindle 10 is adapted to be inserted within the chuck A of a hand-held power tool B, for instance a battery-operated hand tool, such as a hand drill.

Figure 9:
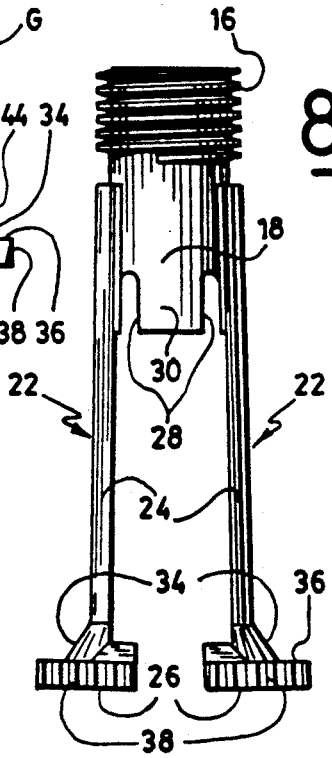
FIG. 9 is an elevation of the jaw unit.

The attachment further includes a jaw unit 14, also molded in one piece out of synthetic resin, such as nylon. The jaw unit 14 includes an externally-threaded screw portion 16, having at one end a cylindrical extension 18 defining a bore 20. A pair of spring jaws 22 are integrally molded with the cylindrical extension 18 and each includes a resilient arm 24 protruding away from cylindrical extension 18 and terminated by a jaw head 26. Each arm 24 is transversely curved and the two arms slightly diverge in the direction of the jaw heads 26 when not inwardly retracted, as shown in FIG. 9. Longitudinally-extending slits 28 extend from the free edge of cylindrical extension 18 adjacent each side of the arms 24, so as to provide lugs 30 which are outwardly deflectable to a limited extent when receiving the tapered tip C of a paint brush handle D, the body portion of the paint brush being shown at E.

Each jaw head 26 has an inner handle clamping surface 32 which is generally concave and is terminated at both ends by flat end surfaces 33. Each jaw head 26 has an outer conical wedging surface 34 and an outwardly-extending step 36 facing towards the screw portion 16. Each jaw head 26 is further formed with a partly-cylindrical outer surface 38, which is knurled, as shown in FIG. 9, so as to prevent its slipping within the hand of a user. Each jaw head 26 is formed at its end face with a cavity 39 to minimize the amount of resin used during molding and to prevent deformation of the molded jaw unit 14.

The attachment includes, as a third separate part, namely a sleeve 40, also molded of synthetic resin, such as nylon. Sleeve 40 completely surrounds the cylindrical extension 18 and the arms 24 of the jaw unit 14. The inner end 42 of sleeve 40 abuts against the skirt 6 of cap nut 2, while the outer end 44 of sleeve 40 is provided with a bevel inner surface 45 which fits the conical wedging surfaces 34 of the two jaw heads 26.

Upon rotation of cap nut 2 by means of its knurling 12 with respect to the jaw unit 14, which is held in position by grasping the knurled outer surfaces 38 of the jaw heads, the sleeve 40 is pushed by the cap nut 2 to cause retraction of the jaw heads 26 and clamping of a handle portion F adjacent the paint brush body E by engagement with the inner clamping surfaces 32 of the jaw heads 26.

The attachment can fit brush handles of lengths and cross-sectional shapes and different sizes.

Figure 5:
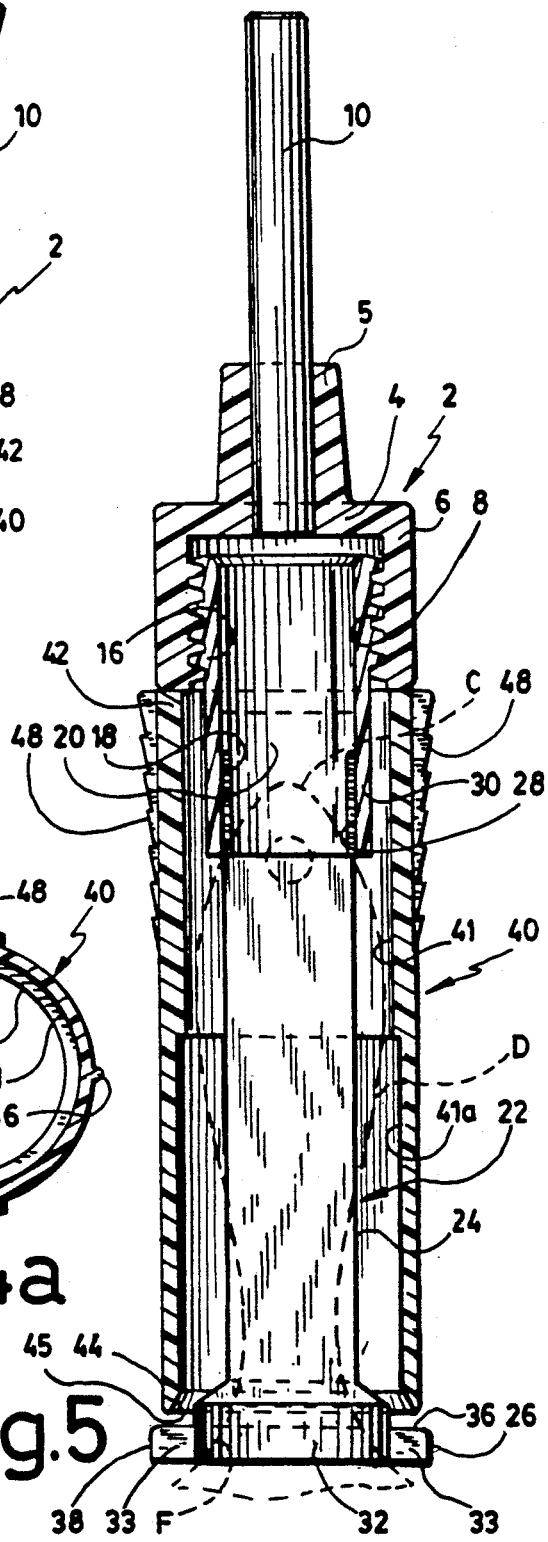
FIG. 5 is a vertical section of the attachment.
Figure 6:
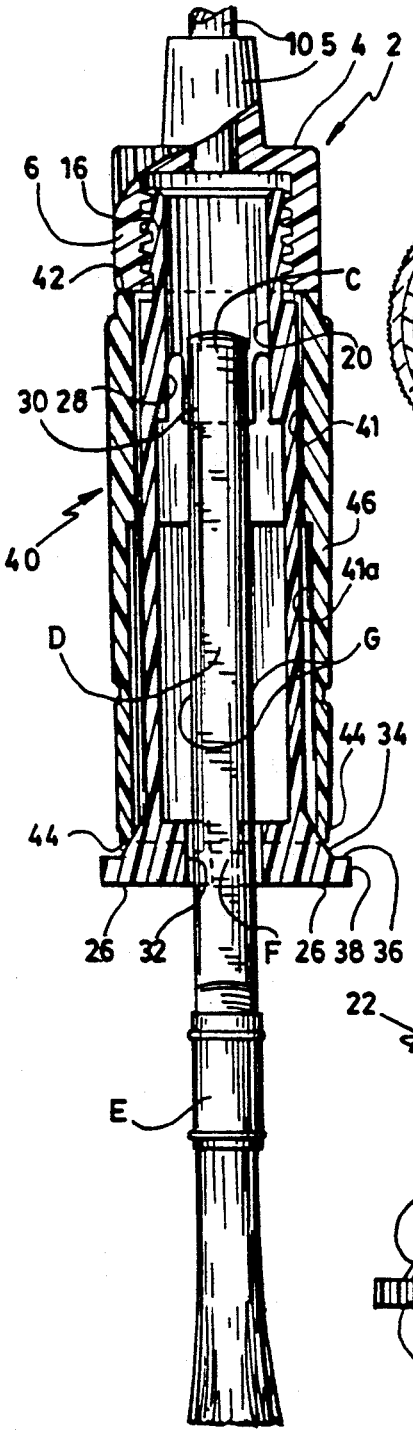
FIG. 6 is another vertical section of the attachment, taken at right angles to the section of FIG. 5, and showing a paint brush handle clamped therein.
Figure 8:
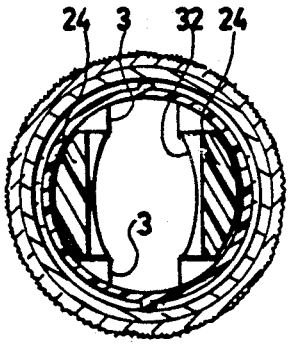
FIG. 8 is a cross-section, taken along line 8—8 of FIG. 7.

The paint brush is preferably oriented with respect to the attachment, so that the opposite flat surfaces G of the handle D face towards the concave clamping surfaces 32 of jaw heads 26, as illustrated in FIGS. 5 and 6. This permits insertion of a rather big handle D within the jaw unit 14, with a minimum of spreading-apart of the two jaw heads 26 and arms 24. The tapered tip C of the brush handle D is automatically held in centered position with respect to the rotation axis of the device, and this irrespective of the orientation of the paint brush with respect to the jaw unit 14.

In their limit retracted position, the two jaw heads 26 partially remain outside of the sleeve 40, being prevented from further entering the same due to the presence of the step 36 which abuts against the outer end 44 of the sleeve. In this maximum retracted position, the flat end surfaces 33 of the jaw heads 26 remain spaced apart.

Sleeve 40 has a smaller diameter bore section 41 adjacent inner end 42 and a larger diameter bore section **41*a* adjacent outer end 44. Bore section 41 has a sliding fit on screw section 16 and extension 18 while bore section 41*a* allows maximum expansion movement of the two diametrically opposed jaw heads 36**.

Figure 7:
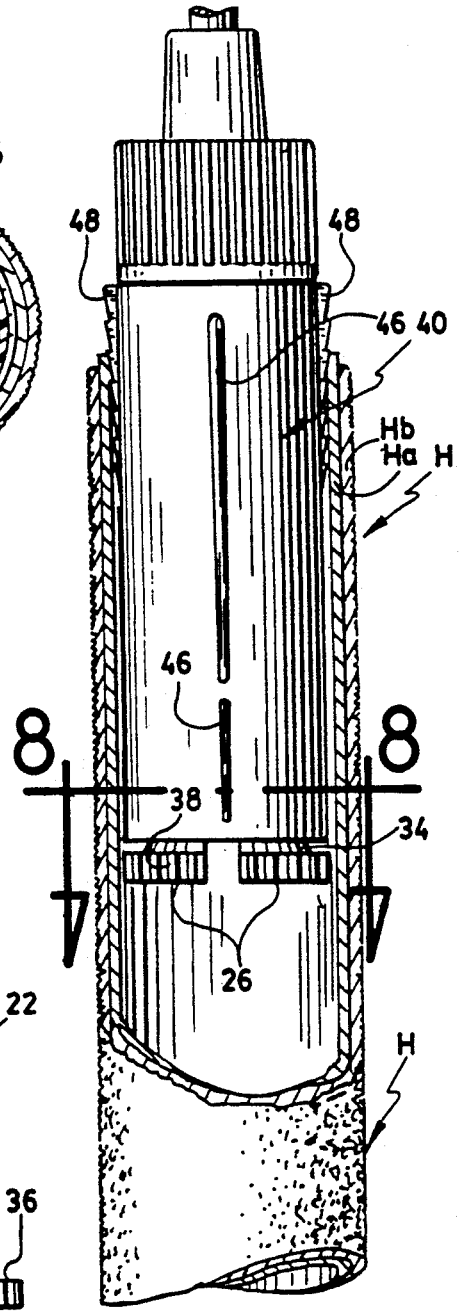
FIG. 7 is a partial elevation of the attachment and showing a paint brush roller clamped thereon.

The sleeve 40 forms a rigid member which can be inserted within a conventional paint roller H to hold the same for spinning. Roller H normally consists of a cardboard cylindrical core Ha covered with short fibers Hb (FIG. 7). The outer surface of the sleeve 40 is provided with paint roller clamping means which includes a pair of diametrically-opposed, longitudinally-extending ribs 46, of equal height throughout, and extending throughout the length of the sleeve 40. These clamping means further include, adjacent the inner end 42 of sleeve 40, two pairs of diametrically-opposed tapered ribs 48, each provided with a transverse knurling, said tapered ribs tapering towards the outer end 44 of the sleeve 40. The tapered ribs 48 positively engage and clamp paint rollers H which may have certain variations in their inner diameter. Thus, paint rollers are positively rotated by the device when connected to the chuck A of power tool B.

To clean a brush, the same is first wiped on the edge of a paint can to remove excess paint. The brush handle is fitted inside the jaw unit 14, as previously described, and the cap nut is rotated with respect to the jaw unit, so as to clamp the paint brush handle firmly. The device is then attached to the power drill. The brush is placed in a solvent in a container J and is rotated. It is then removed from the solvent and again rotated in an empty plastic container or bag, or the like. The paint roller H is cleaned in a similar manner after the excess paint has been scraped away by a conventional scraper.

Figure 10:
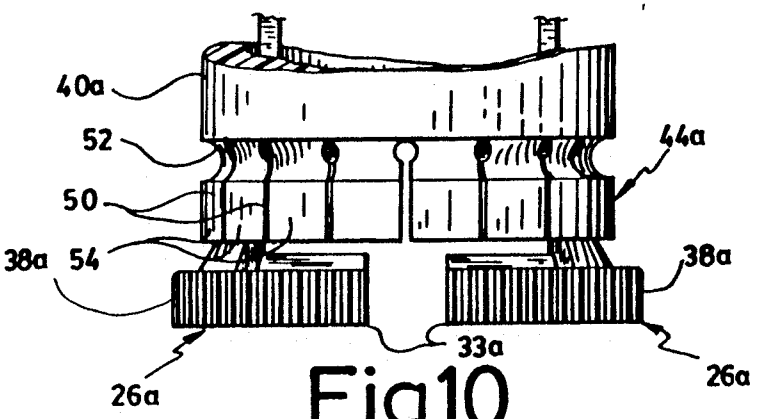
FIG. 10 is a partial elevation of the outer end of a modified embodiment of the attachment.
Figure 11:
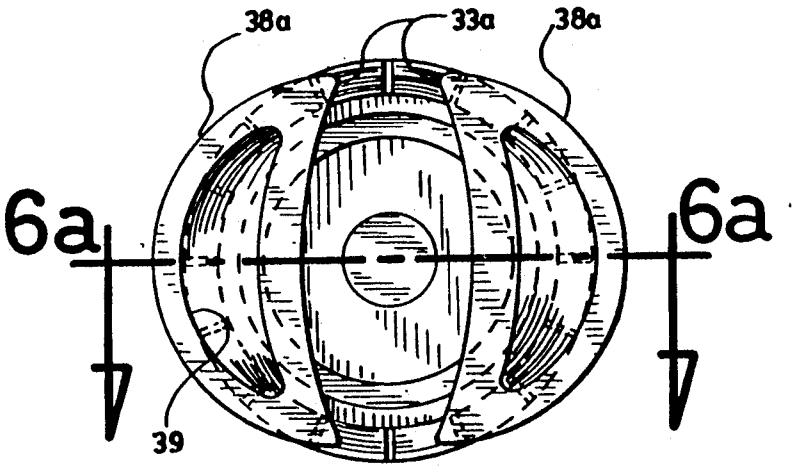
FIG. 11 is an end view of the modified embodiment of FIG. 10.
Figure 12:
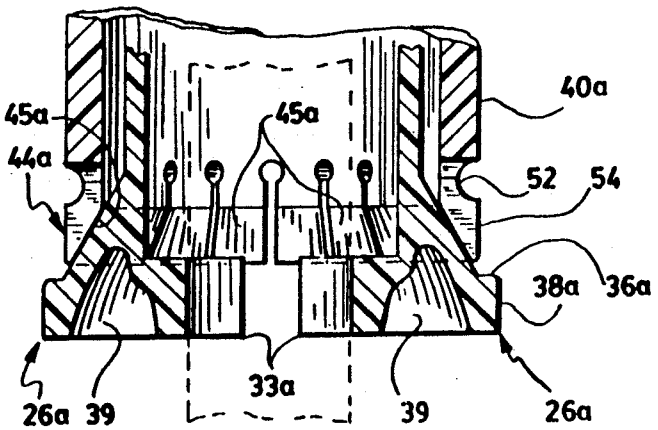
FIG. 12 is a partial longitudinal section, taken along line 12—12 of FIG. 11.
Figure 13:
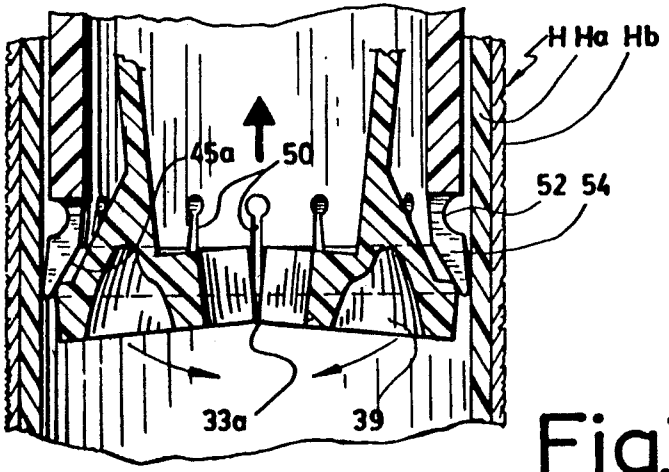
FIG. 13 is a view similar to that of FIG. 12, but showing the device in roller-clamping position.

FIGS. 10 to 13 show a modification of the previously-described attachment, which is designed to positively clamp the paint roller in a zone axially spaced from the zone clamped by the tapered ribs 48. The outer end **44*a* of the sleeve 40*a* is provided with a plurality of equally-spaced, longitudinally-extending slits 50, as shown in FIG. 10, which, together with a circumferential external groove 52 made in the outer surface of the sleeve 40*a*, defines radially-outwardly deflectable end sections 54. The jaw heads 26 are slightly modified, so that the partly-cylindrical outer surfaces 38*a* have a slightly smaller radius of curvature than the equivalent surfaces 38 of the first embodiment. Also, the equivalent bevel inner face 45*a* is more pronounced than the bevel face 45 of the first embodiment. To use the attachment, the two jaw heads 26*a* are first manually pressed together with their end faces 33*a* in mutual abutment. In this maximum retracted position of the two jaw heads 26*a*, the two surfaces 38*a* form a complete cylindrical surface of a diameter smaller than the maximum diameter of inner bevel face 45*a*. By rotating the cap nut 2, the steps 36*a* will clear the outer end 44*a* of the sleeve 40*a* and the edge of the surfaces 38*a* will engage the bevel inner surface 45*a*. Further rotation of the cap nut 2 will cause outward deflection of the end sections 54, which will positively engage and grip the inside of a paint roller H inserted around the sleeve 40*a***. Thus, the paint roller will be positively clamped at two longitudinally-spaced portions thereof and, thus, positively held coaxial with the spinning axis of the tool.

I claim:

1. An attachment securable to an electric motor for use in cleaning paint brushes and paint rollers, said paint brushes including a handle having a pointed tip, said attachment comprising a jaw unit including a screw portion with external screw threads, a cylindrical extension at one end of said screw portion defining a generally cylindrical bore to receive and center the pointed tip of a paint brush handle, said jaw unit further including spring jaws integrally formed with said cylindrical extension and including elongated resilient arms protruding from said cylindrical extension and each terminated by a jaw head having an inner clamping surface and an outer generally conical wedging surface, a nut surrounding and screwed on said screw portion, a cylindrical sleeve surrounding said cylindrical extension and said arms and having an inner end engaged by said nut and an outer end engaging said wedging surfaces, and a spindle fixed to said attachment and axially extending from said nut away from said sleeve and jaw heads to be secured to an electric motor for spinning of the attachment, said sleeve having at its outer surface roller clamping means for engaging and clamping a paint roller in which said sleeve is inserted, screwing of said nut on said screw portion axially shifting said sleeve which causes retraction of said jaw heads for clamping a paint brush handle.

2. An attachment as defined in claim 1, wherein said nut is a cap nut having an end wall and an inwardly-threaded skirt, said spindle being secured to said end wall and being co-axial with said skirt.

3. An attachment as defined in claim 1, wherein said roller clamping means includes longitudinally-extending ribs on the outer surface of said sleeve.

4. An attachment as defined in claim 3, wherein some of said ribs are located adjacent said inner end of said sleeve and include tapered ribs tapering in the direction of said outer end of said sleeve.

5. An attachment as defined in claim 4, wherein said tapered ribs are transversely knurled.

6. An attachment as defined in claim 1, wherein said roller clamping means includes a series of deflectable end sections formed between a series of longitudinally-extending, circumferentially spaced slits made in said outer end of said sleeve, said jaw heads having mutually facing concave surfaces terminated by mutually-engageable end abutment surfaces, said end sections outwardly deflectable upon engagement with said wedging surfaces and upon mutual engagement of said abutment surfaces during retraction of said jaw heads.

7. An attachment as defined in claim 6, wherein said roller clamping means further includes tapered ribs protruding from the outer surface of said sleeve and located adjacent said inner end of said sleeve, said tapered ribs tapering in the direction of said outer end of said sleeve.

8. An attachment as defined in claim 1, wherein there are two such arms which are diametrically opposed and wherein said cylindrical extension is formed with longitudinal slits along each side of each arm, whereby said cylindrical extension defines, between said slits, outwardly-deflectable lugs adapted to grip the tapered tip of a paint brush handle.

9. An attachment as defined in claim 8, wherein said roller clamping means includes longitudinally-extending ribs on the outer surface of said sleeve.

10. An attachment as defined in claim 6, wherein there are two such arms which are diametrically opposed and wherein said cylindrical extension has longitudinal slits disposed along each side of each arm, whereby said cylindrical extension defines, between said slits, outwardly-deflectable lugs adapted to grip the tapered tip of a paint brush handle.

11. An attachment as defined in claim 2, wherein said skirt and said jaw heads have a knurled outer surface.

12. An attachment as defined in claim 2, further including a radially outwardly-extending step formed on each jaw head at the larger base of said conical wedging surface and abutting against said outer end of said sleeve in the radially-retracted innermost position of said jaw heads.

13. An attachment as defined in claim 6, wherein each jaw head has a partly-cylindrical outer surface, said partly-cylindrical outer surfaces forming a completely cylindrical outer surface when said abutment surfaces are in mutual abutment, said cylindrical outer surface at least partially entering the outer end of said sleeve upon retraction of said jaw heads upon mutual engagement of said abutment surfaces to positively outwardly deflect said deflectable end sections.

* * * * *